US007914362B2

(12) United States Patent
Bunch et al.

(10) Patent No.: US 7,914,362 B2
(45) Date of Patent: Mar. 29, 2011

(54) METHOD OF EVALUATING THE QUALITY OF A LAPPING PLATE

(75) Inventors: Richard Dale Bunch, San Jose, CA (US); Linden James Crawforth, San Jose, CA (US); Eduardo Padilla, Hayward, CA (US); Xiao Z. Wu, San Jose, CA (US)

(73) Assignee: Hitachi Global Storage Technologies, Netherlands B.V., Amsterdam (NL)

( * ) Notice: Subject to any disclaimer, the term of this patent is extended or adjusted under 35 U.S.C. 154(b) by 788 days.

(21) Appl. No.: 11/289,930

(22) Filed: Nov. 30, 2005

(65) Prior Publication Data

US 2007/0123150 A1 May 31, 2007

(51) Int. Cl.
*B24B 51/00* (2006.01)

(52) U.S. Cl. ..... 451/5; 451/8; 451/11; 451/29; 451/30; 451/387; 451/405

(58) Field of Classification Search ..... 451/5, 8, 451/11, 387, 405, 30, 29
See application file for complete search history.

(56) References Cited

U.S. PATENT DOCUMENTS 5,632,669 A 5/1997 Azarian et al.
5,722,155 A 3/1998 Stover et al.
5,735,036 A * 4/1998 Barr et al. ..... 29/603.12
5,772,493 A 6/1998 Rottmayer et al.
6,163,954 A * 12/2000 Nakagawa ..... 29/603.12
6,170,149 B1 1/2001 Oshiki et al.
6,196,897 B1 3/2001 Suto et al.
6,347,983 B1 2/2002 Hao et al.
6,497,798 B1 12/2002 Rabinski et al.
6,531,399 B2 3/2003 Kojima et al.
6,585,559 B1 * 7/2003 Griffin et al. ..... 451/5
6,609,948 B1 8/2003 Fontana et al.
6,679,760 B2 1/2004 Fukuroi et al.
6,760,197 B2 7/2004 Boutaghou et al.
6,949,004 B1 9/2005 Broussalian et al.
7,014,530 B2 * 3/2006 Kasiraj et al. ..... 451/8
7,100,266 B2 * 9/2006 Plumer et al. ..... 29/603.14
2002/0012204 A1 1/2002 Boutaghou et al.
2002/0063984 A1 5/2002 McClellan et al.
2002/0126421 A1 9/2002 Takahashi et al.
2003/0026046 A1 2/2003 Yamakura et al.

(Continued)

FOREIGN PATENT DOCUMENTS

JP 63052968 3/1988

(Continued)

OTHER PUBLICATIONS

Appl. Phys. A 77,923-932 (2003) "On the advanced lapping process in the precision finishin of thin-film magnetic recording heads for rigid disc drives".

(Continued)

*Primary Examiner* — Joseph J Hail, III
*Assistant Examiner* — Robert Scruggs

(57) ABSTRACT

Embodiments of the present invention pertain to a evaluating the quality of a lapping plate. In one embodiment, information that indicates the quality of a lapping plate is received while the lapping plate is being used to lap a slider, and the information is used to evaluate the quality of the lapping plate while the lapping plate is being used to lap the slider.

19 Claims, 17 Drawing Sheets

U.S. PATENT DOCUMENTS

| | | | | |
|---|---|---|---|---|
| 2003/0200041 | A1* | 10/2003 | Church et al. | 702/104 |
| 2004/0088137 | A1* | 5/2004 | Sermon et al. | 702/168 |
| 2004/0097173 | A1* | 5/2004 | Crawforth et al. | 451/41 |
| 2004/0176013 | A1 | 9/2004 | Church et al. | |
| 2005/0040206 | A1* | 2/2005 | Adams et al. | 227/131 |
| 2005/0059323 | A1* | 3/2005 | Beaucage et al. | 451/5 |
| 2005/0191946 | A1* | 9/2005 | Beaucage et al. | 451/8 |
| 2006/0067004 | A1* | 3/2006 | Cyrille et al. | 360/316 |

FOREIGN PATENT DOCUMENTS

| | | |
|---|---|---|
| JP | 3049004 | 3/1991 |
| JP | 10269530 | 10/1998 |
| JP | 2000202768 | 7/2000 |
| JP | 2003011054 | 1/2003 |
| JP | 2003039319 | 2/2003 |

OTHER PUBLICATIONS

IEEE Mag-37 n.2, pp. 974.ff "The effect of Lapping Method on the Thermal Reliability of a GMR Head Based on Black's Equation".

IEEE Mag-37 n.4, pp. 1713.ff "Resistance Measurement of GMR Heads as a Magnetic Performance Indicator".

* cited by examiner

Side View

Side View

Side View

Side View

METHOD OF EVALUATING THE QUALITY OF A LAPPING PLATE

TECHNICAL FIELD

Embodiments of the present invention relate to manufacturing sliders. More specifically, embodiments of the present invention relate to evaluating the quality of a lapping plate while the lapping plate is being used to lap sliders.

BACKGROUND ART

Most computers use disk drives to store data. A disk drive typically includes platters that the data is stored on and a recording head that is used to write data onto the platters and to read the data from the platters. The recording head is manufactured to include what is commonly known as a slider that has aerodynamic properties to fly over a platter. A slider flys over a location on a platter for the purpose of writing data to that location or reading data from that location.

FIG. 1 depicts a side view of a conventional slider. The slider 100 includes a write head 108 for writing data to a platter and a read sensor 106 for reading data from a platter. The read sensor 106 has a height, which is commonly known as a stripe-height 102. The air bearing surface 104 (ABS) of the slider 100 provides the aerodynamic properties that enables the slider 100 to "fly" over a platter and to be positioned over a desired location on the platter.

In order for the slider 100 as well as the read sensor 106 and the write head 108 to function properly, the ABS 104 needs to be very flat and smooth and the read sensors 106 need to have an appropriate stripe-height 102. A lapping plate is used for grinding and/or polishing the ABS 104 (commonly referred to as the "lapping process") in order to achieve the desired smoothness and the desired stripe-height 102. A lapping plate typically has abrasive particles, such as diamond particles, on its surface that can be used to remove material from the slider 100. Diamonds are typically embedded into the plate surface using what is commonly known as a "charging process." It is necessary that the lapping plate be able to remove a sufficient amount of material from the ABS 104 of the slider 100 within an appropriate amount of time.

The dimensions of read heads are shrinking in order to achieve greater recording densities. The smaller dimensions of the read heads makes the sensors 106 more susceptible to damage from mechanical stress that results from the lapping process. Lapping process inherently is a mechanical stress process since the diamond particles have to remove materials from sliders. The quality of a lapping plate may not be good enough to be used for lapping sliders 100 when the lapping plate damages read sensors 106 due to excessive stress even though the lapping plate is very capable of removing material. For example, large scratches may form on the surface of a lapping plate due to the charging process or lapping process. Another example is that many small diamond particles can cluster together to effectively form large diamond particles. In both cases, the stress on read heads may be sufficient to damage sensors 106.

Typically, sliders 100 are removed from the lapping process, washed and placed in n external tester to determine their (100) magnetic performance and to determine whether the sensors 106 have been damaged by the lapping process. Removing sliders 100 from the lapping process in order to test the sliders 100 makes it difficult to provide fast feed-back to the lapping process.

For these and other reasons, there is a need to evaluate the quality of a lapping plate. For these and other reasons, there is also a need to reduce mechanical stress caused by the lapping process which can result in damaged sensors associated with sliders. For these and other reasons, there is also a need to provide fast feed-back to the lapping process.

DISCLOSURE OF THE INVENTION

Embodiments of the present invention pertain to a evaluating the quality of a lapping plate. In one embodiment, information that indicates the quality of a lapping plate is received while the lapping plate is being used to lap a slider, and the information is used to evaluate the quality of the lapping plate while the lapping plate is being used to lap the slider.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should not be understood as being drawn to scale except if specifically noted.

PREFERRED EMBODIMENT OF THE INVENTION

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of the present invention, numerous specific details are set forth in order to provide a thorough understanding of the present invention. In other instances, well-known methods, procedures, components, and circuits have not been described in detail as not to unnecessarily obscure aspects of the present invention.

Overview

The quality of a lapping plate has a direct affect on a slider's electric and magnetic performance. For example, a lapping plate with inadequate quality, due to either scratches or large diamond clusters on the lapping plate, can damage the read sensors embedded in a slider. Therefore, according to embodiments of the present invention, the quality of a lapping plate is evaluated while the lapping plate is being used to lap a slider (commonly referred to as evaluating "in-situ"). As already stated, using the conventional process, sliders are removed from the lapping process in order to test the magnetic performance of a slider and to determine whether the sensors have been damaged. By providing a method and an apparatus, according to embodiments of the present invention, for evaluating the quality of a lapping plate while the lapping plate is being used to lap a slider, fast feed-back to the lapping process is provided.

Since, according to one embodiment, the quality of a lapping plate is evaluated while the lapping process is being performed, feedback pertaining to the quality of the lapping plate is provided quickly back to the lapping process, according to another embodiment. Further, since according to embodiments of the present invention the lapping plate is being evaluated during the lapping process, the amount of mechanical stress that is being applied to sliders during the lapping process can be constantly evaluated. Thus the probability of damaging sensors is reduced.

Figure 1:
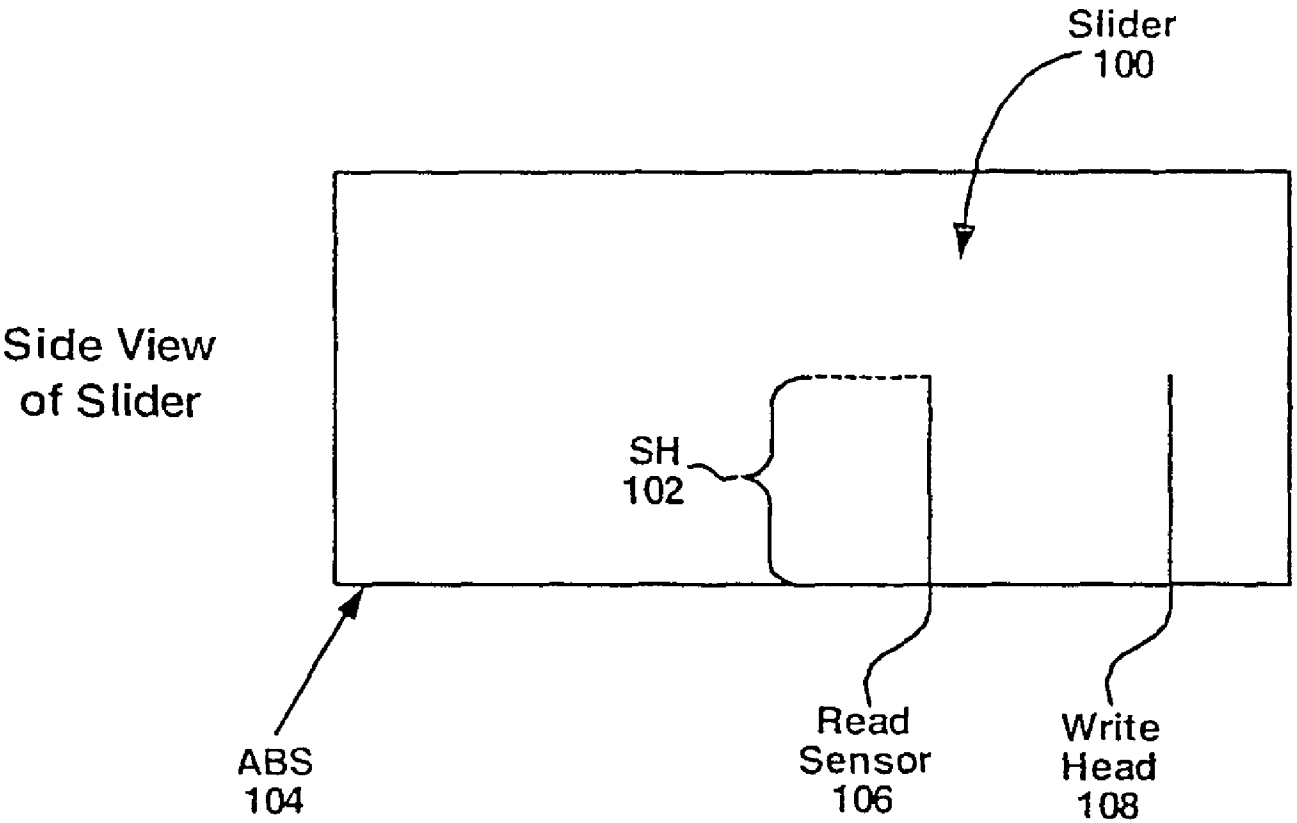
PRIOR ART FIG. 1
FIG. 1 depicts a side view of a conventional slider.
Figure 2:
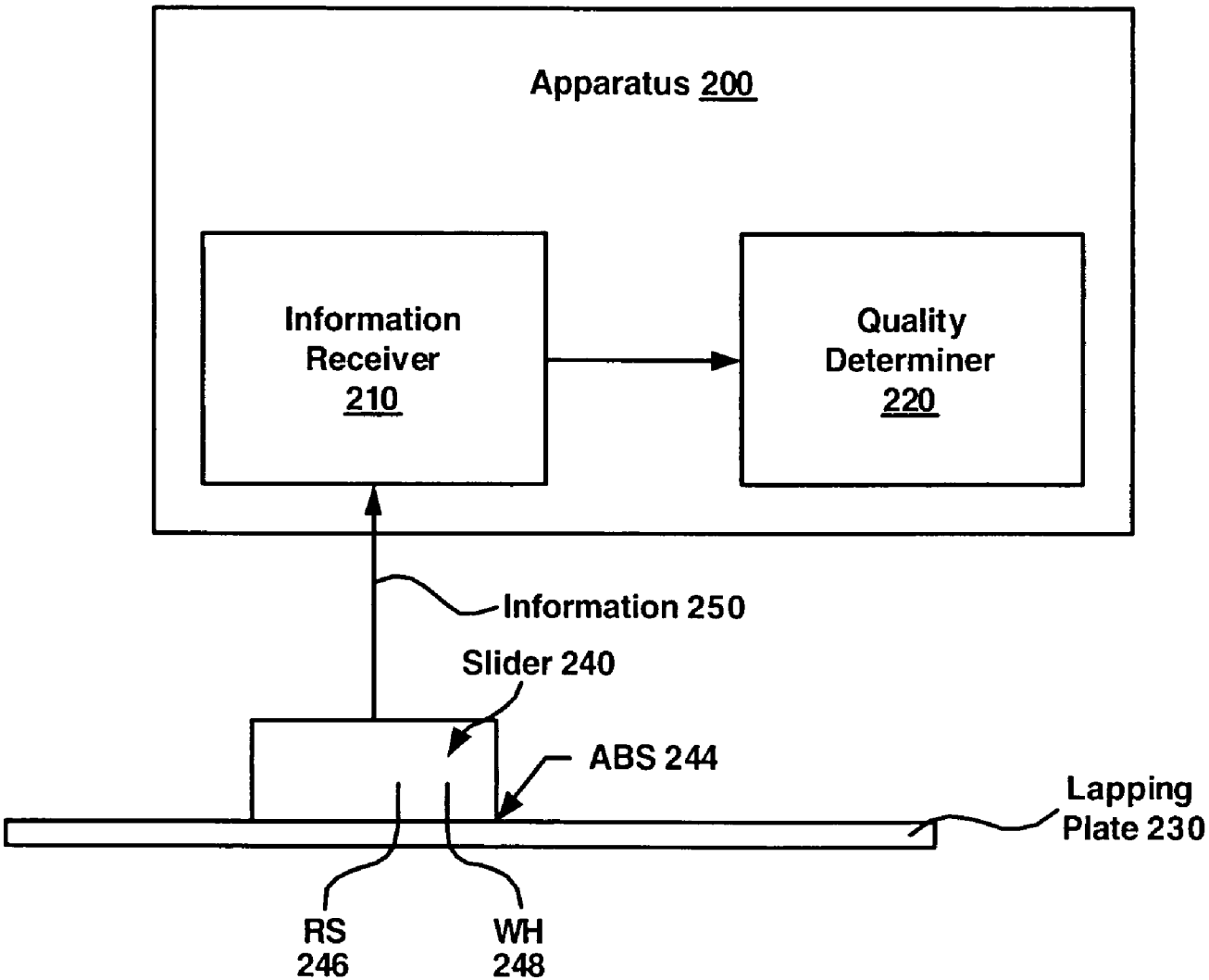
FIG. 2 depicts a block diagram of an apparatus for evaluating the quality of a lapping plate, according to embodiments of the present invention.

FIG. 2 depicts a block diagram of an apparatus for evaluating the quality of a lapping plate, according to embodiments of the present invention. The blocks in FIG. 2 can be arranged differently than as illustrated, and can implement additional or fewer features than what are described herein. Further, the features represented by the blocks in FIG. 2 can be combined in various ways.

As depicted in FIG. 2 the apparatus 200 includes an information receiver 210 and a quality determiner 220. FIG. 2 further depicts a lapping plate 230 that is being used for lapping the ABS 244 of a slider 240. The slider 240 includes a read sensor 246, a write head 248, and an ABS 244. As the lapping process is being performed, information 250 indicating the quality of the lapping plate 230 is received by the information receiver 210 associated with the apparatus 200, according to an embodiment. The information 250 indicating the quality of the lapping plate 230 is provided to the quality determiner 220, which evaluates the quality of the lapping plate 230 based on the information 250 while the lapping plate 230 is being used to lap the slider 240, according to one embodiment. According to embodiments of the present invention, the information 250 can indicate the resistance value associated with the read sensor 246 and/or the information 250 can indicate the amplitude of a magnetic signal detected by a read sensor 246, as will become more evident.

According to one embodiment, the information receiver 210 provides circuitry for measurement and control functions (referred to herein as "measurement and control circuitry"). The measurement function provides excitation and measurement circuits for the resistance and amplitude measurements and the control function controls the lapping force and speed. According to another embodiment, the quality determiner 220 is a "process controller" that provides software algorithms that can be executed by a microprocessor. The "process controller" can control the lapping process via the "measurement and control circuitry" and determine when the lapping process is completed. The "process controller" can also calculate the resistance, sigma/mean of the resistance, the amplitude and flip rates, as will become more evident. Further, the "process controller" can provide information indicating whether the quality of a lapping plate is acceptable or not acceptable.

Information from the Resistanceasurement

The read sensor 246 is used to read data by detecting the magnetic signals that are recorded on a platter. During the lapping process, debris, some of which are conductive, from the lapping plate 230 and/or from materials removed from the ABS 244 can collect around the read sensor 246 can interfere with the read sensor 246's ability to detect the magnetic signal.

Figure 3A:
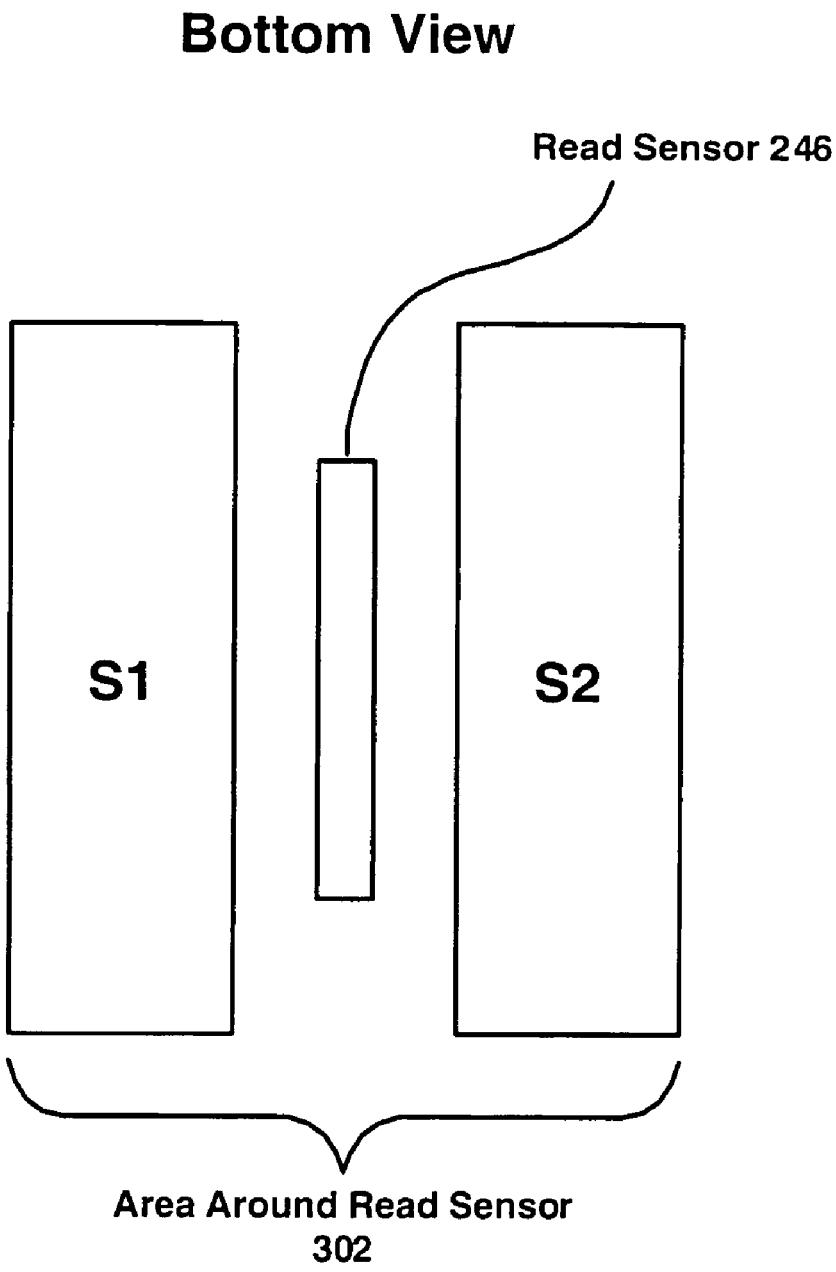
FIG. 3A is a bottom view of an area around the read sensor, according to one embodiment.
Figure 3B:
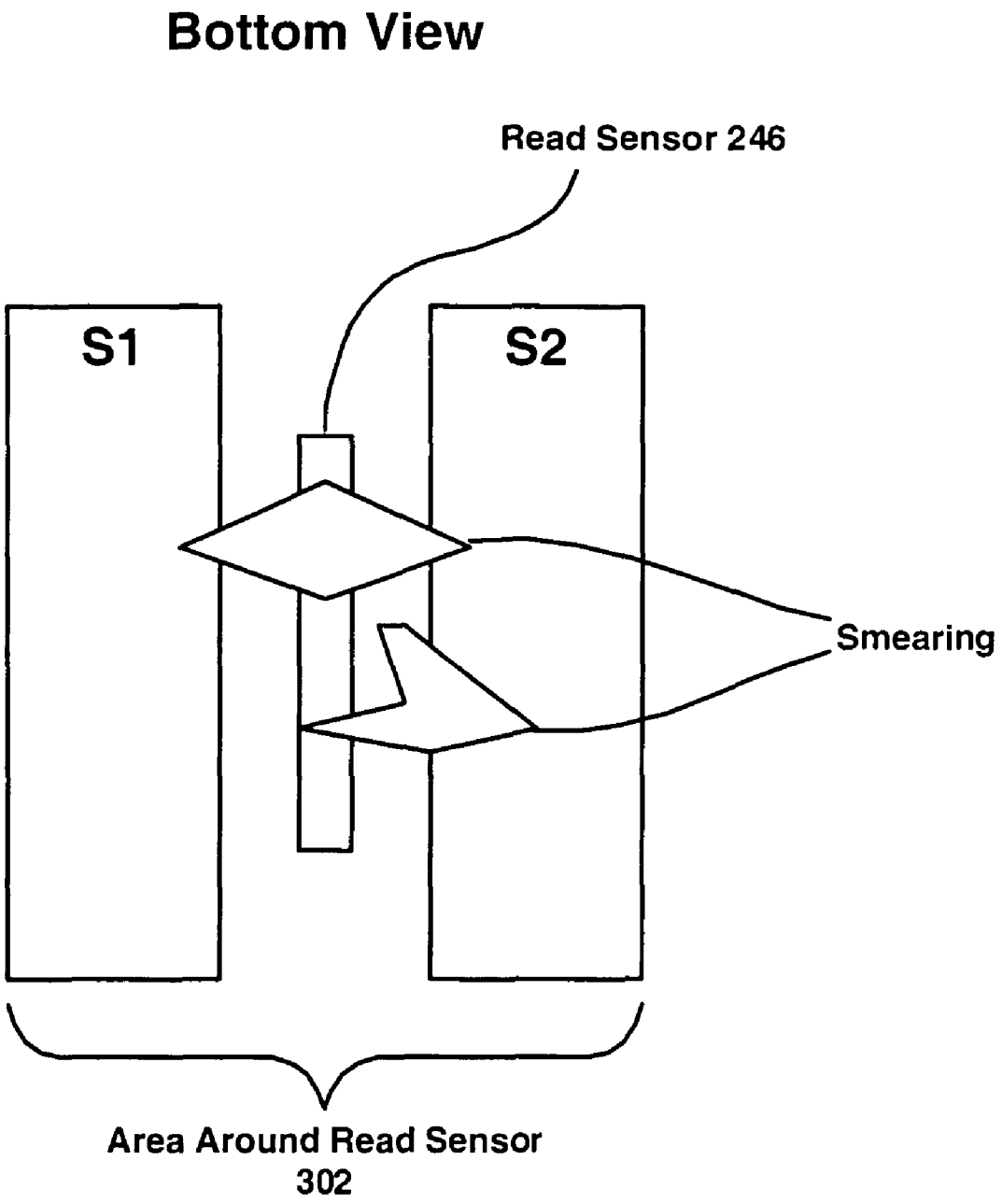
FIG. 3B is a bottom view of an area around the read sensor that has been smeared, according to one embodiment.

FIG. 3A is a bottom view of an area around the read sensor 302, according to one embodiment. As depicted in FIG. 3A, the read sensor 246 is in between two shields S1, S2. Shields are typically made of metal, and they are used to shield the read sensors from the stray magnetic fields. FIG. 3B is a bottom view of an area around the read sensor that has been smeared. Smearing occurs when conducting particles bridge the read sensors 246 and shields S1 and/or S2. Smearing causes a portion of electric current to find alternative paths through the shields rather than solely through the read sensor so that the resistance measurement of the read sensor 246 is smaller than it should be and does not reflect the true resistance of the read sensor. Since, according to one embodiment, the read sensor's resistance is used for controlling the lapping process and for determining when the quality of a lapping plate has degraded to the point that the lapping plate should no longer be used, inaccurate resistance reading caused by smearing will interfere with controlling the lapping process. Furthermore, any remaining smearing of a finished slider will result in higher noise of the head in the disk drive thus reducing the performance of the head. When the quality of a lapping plate is good, the metal surface of the lapping plate is well protected by the diamond particles, therefore, smearing is much less likely to occur.

Figure 4A:
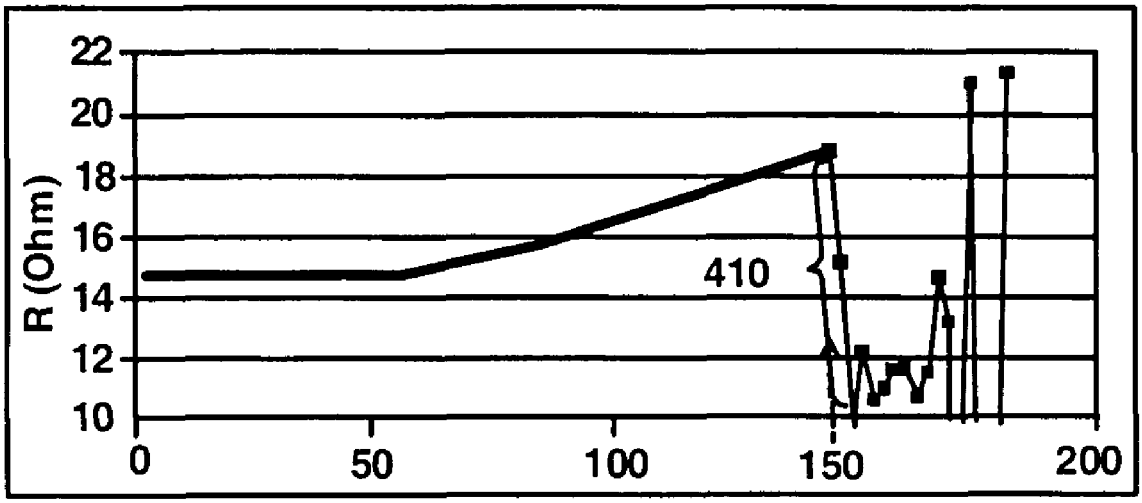
FIG. 4A depicts a graph of measurements of resistance R in Ohms for a slider over time in seconds as the slider is being lapped, according to embodiments of the present invention.
Figure 4B:
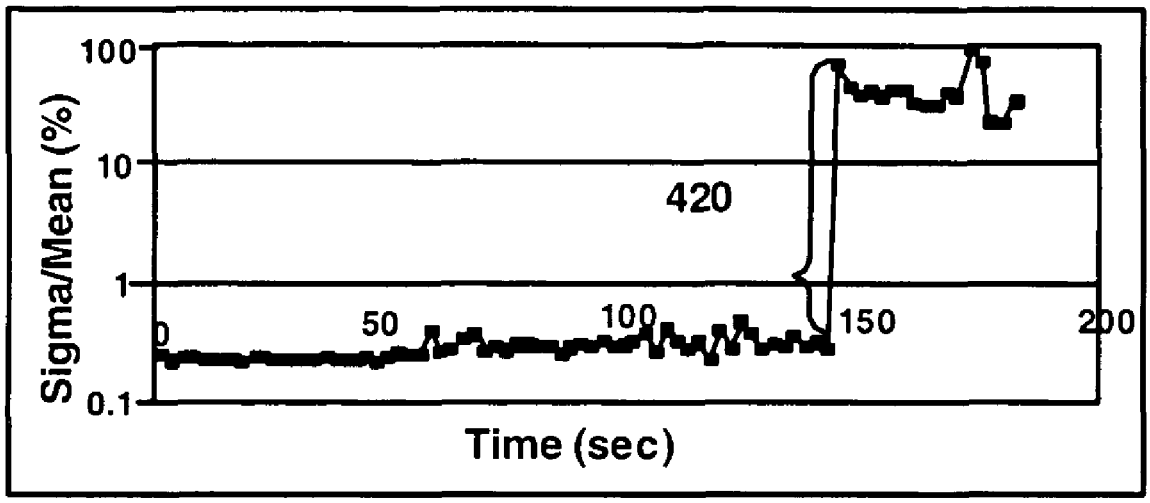
FIG. 4B depicts a graph of measurements of resistance R in terms if sigma/mean for a slider over time in seconds as the slider is being lapped, according to embodiments of the present invention.
Figure 4C:
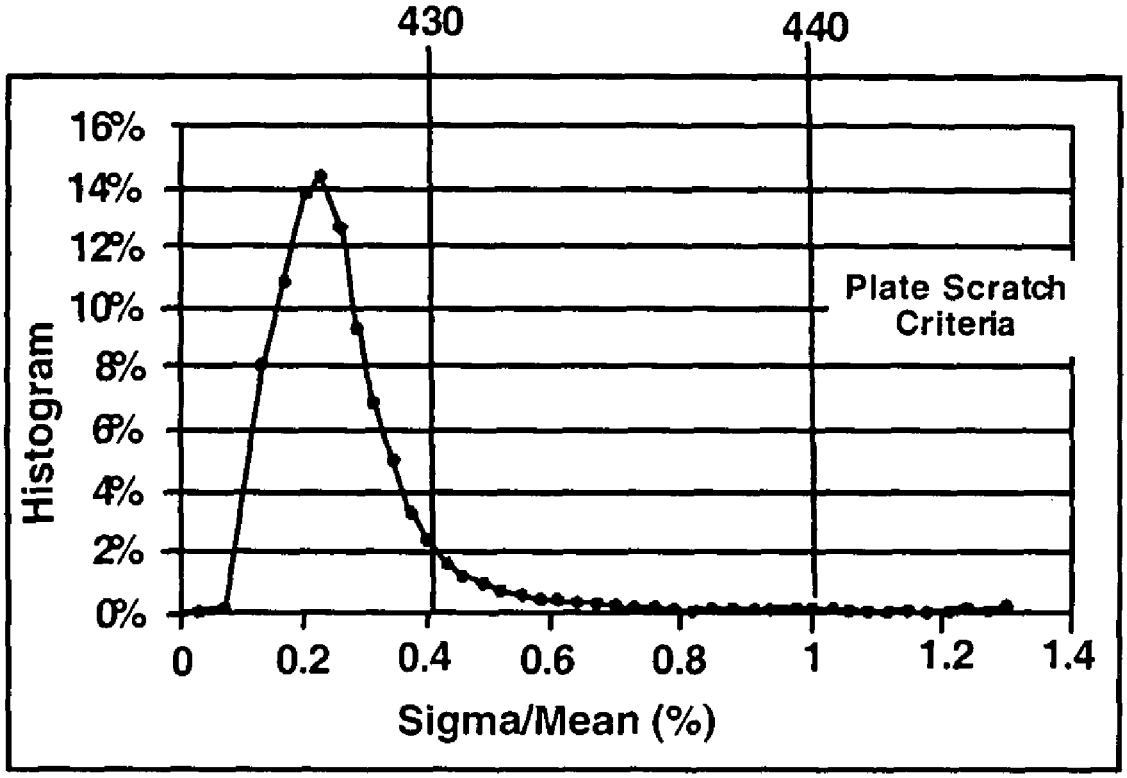
FIG. 4C depicts a histogram of sigma/mean, according to one embodiment.

According to embodiments of the present invention, fluctuations in resistance can be used for evaluating the quality of a lapping pad. FIGS. 4A, 4B, 4C are graphs of measurements of resistance, according to embodiments of the present invention. FIG. 4A depicts a graph of measurements of resistance R in Ohms for a slider as a function of time as the slider is being lapped, according to embodiments of the present invention. For the sake of illustration, assume that the resistance of the read sensor 246 associated with the slider 240 is being measured as the slider 240 is being lapped using a lapping plate 230 depicted in FIG. 2. Each point of data depicted on the graph in FIG. 4A may represent one measurement or could represent an average of many measurements, of resistance associated with the read sensor 246.

The resistance associated with a read sensor 246 is inversely proportional to the stripe-height of the read sensor 246. For example, as the stripe-height decreases due to the lapping process, the resistance should increase smoothly and monotonically as depicted in FIG. 4A from time 0 to approximately time 140 seconds. At approximately time 140 seconds, the resistance R begins to fluctuate, for example, by dropping downwards at point 410. The fluctuation in resistance R can be used as an indication that the quality of the lapping plate 230 has degraded, according to one embodiment. For example, when the resistance R drops (at point 410 for example) by approximately 1% or more, then the quality of the lapping plate 230 is inadequate, according to one embodiment. The lapping plate 230 can be replaced with a new lapping plate if its (230) quality is inadequate.

In some cases when a plate is damaged and smearing occurs, it is possible that an average of resistance R may continue to increase smoothly. resistance fluctuations measured at a higher sampling frequency may provide more sensitive smearing indicator. Sigma is the root-mean-squared of multiple measurements of resistance at high frequency, according to one embodiment, and the mean is the average of those same measurements, according to another embodiment. The percent of sigma resistance over mean resistance (e.g., sigma/mean %), is a more sensitive measurement of the quality of a lapping plate 230, according to one embodiment. For example, sigma can be the root-mean-squared of 1000 measurements and the mean can be the average of the same 1000 measurements. The average of those 1000 measurements is depicted as a function of time in FIG. 4A.

FIG. 4B depicts a graph of measurements of resistance R in terms if sigma/mean for a slider over time in seconds as the slider is being lapped, according to embodiments of the present invention. For the sake of illustration, assume that the resistance of the read sensor 246 associated with the slider 240 is being measured as the slider 240 is being lapped using a lapping plate 230 depicted in FIG. 2. At approximately time 140 seconds, the sigma/mean of resistance begins to fluctuate at point 420. This fluctuation indicates that the quality of the lapping plate 230 has degraded, according to one embodiment. For example, when the sigma/mean measurement of resistance fluctuates by 1% or more, then the quality of the lapping plate 230 is inadequate, according to one embodiment. The lapping plate 230 can be replaced with a new lapping plate if its (230) quality is inadequate.

FIG. 4C depicts a histogram of sigma/mean, according to one embodiment. Lapping plates that are of sufficiently high enough quality to be used for lapping are indicated at point 430 by a sigma/mean below 0.4%. The lapping plates indicated by the 1% (at point 440) or greater sigma/mean suggest that the plate many have been scratched and there is significant resistance fluctuation. This lapping plates should be replaced with new lapping plates immediately, according to one embodiment. The plate with sigma/mean between 0.4% and 1% has marginal quality, according to another embodiment.

According to one embodiment, several measurements of resistance can be received for a time interval and used to calculate an average of resistance, as depicted in FIG. 4A, and/or to calculate a sigma/mean of resistance, as depicted in FIG. 4B. The time interval should be chosen to be short enough such that the resistance does not increase significantly, yet large enough to contain enough sampling points to obtain a statistically meaningful average and sigma/mean. According to one embodiment, the time interval is between 10 milliseconds and 10 seconds.

The information receiver 210 receives information 250 that indicates the resistance value, according to one embodiment, and the quality determiner 220 uses the quality of the resistance measurement to evaluate the quality of a lapping plate 230 while the lapping plate 230 is being used to lap a slider 240, according to another embodiment. For example, the information receiver 210 can receive a measurement of the-resistance value R for a slider 240 or multiple measurements of the resistance R for a slider 240 over time.

The quality determiner 220 can use the one or more measurements of the resistance R to determine whether the resistance R is fluctuating. The quality determiner 220 can calculate an average of more than one measurement of resistance R as depicted in FIG. 4A, a sigma/mean as depicted in FIG. 4B. Further the quality determiner 220 can use the resistance R to determine whether the lapping plate has inadequate quality based on the criteria described herein. Examples of criteria include, but are not limited to, determining that the resistance R drops by approximately 1% or more or determining that the sigma/mean measurement of resistance fluctuates by 1% or more.

Information from the Amplitude Measurement

Figure 5A:
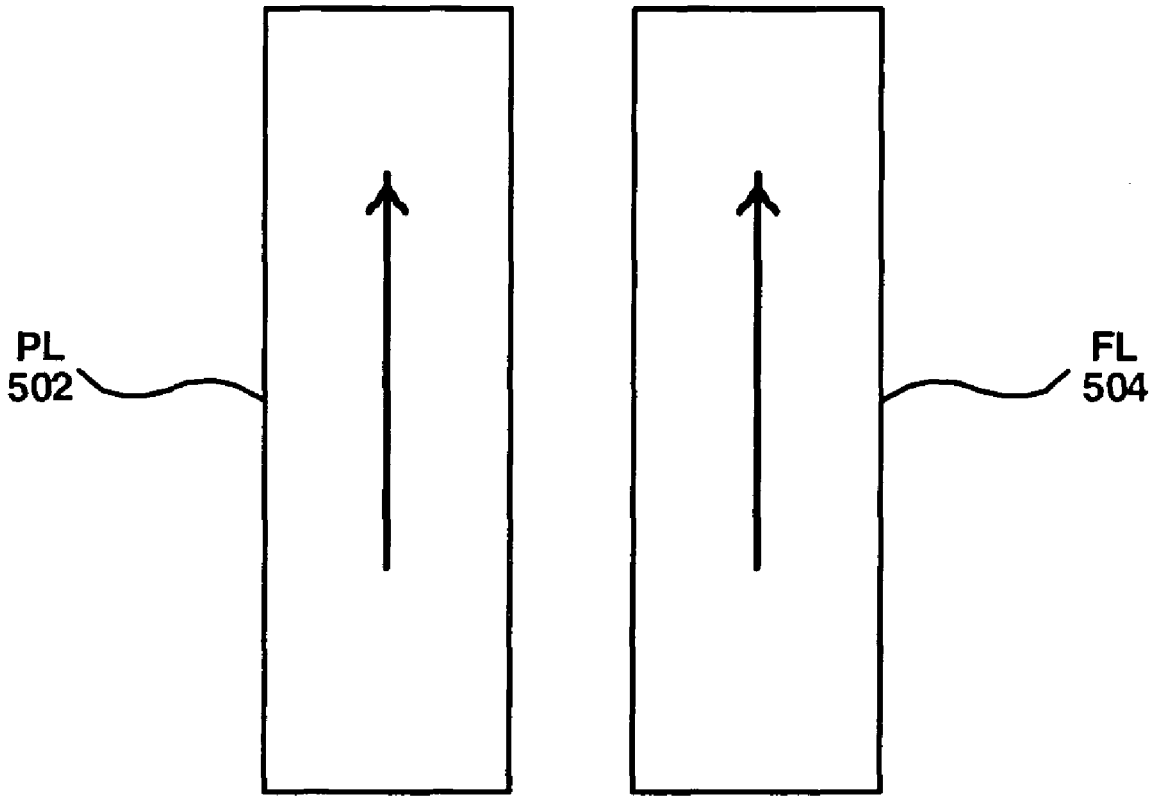
FIGS. 5A-5D depict the pinning layer and the free layer for a sensor in various positions, according to one embodiment of the present invention.

A read sensor 246 is used to read data, in the form of magnetic signals, from a platter. The magnetic signals are translated into binary 1s and 0s. Typically, a read sensor 246 includes what is commonly known as a pinning layer 502 and a free layer 504 in order to translate the magnetic information into binary 1s and 0s. The moment of the pinned layer 502 is set during the wafer manufacturing process and should stay fixed in the subsequent manufacturing process and final applications in the disk drives For example, as depicted in FIGS. 5A and 5B the wafer process can set the moment of the pinned layer 502 upwards as indicated by the arrow.

The free layer 504 can rotate in response to the external magnetic signals. The external field can applied for the purpose of testing, or from the magnetic field associated with information stored on a platter. For example referring to FIG. 5A, when the magnetic signal on the disk represents a binary 1, the moment of the free layer 504 typically is rotated upward as indicated by the arrow. In contrast, referring to FIG. 5B, when the magnetic signal on the disk represents a binary 0, the moment of the free layer 504 typically is swayed downward as indicated by the arrow. The pinning layer 502 is used as a reference to determine whether the moment of the free layer 504 is parallel to the pinning layer 502 (FIG. 5A) or not parallel to the pinning layer 502 (FIG. 5B).

More specifically, the resistance value for a read write head is a function of the angle between the moments of the pinned layer 502 and the free layer 504. The change of the resistance in response to the magnetic signal (e.g., external field) is called amplitude. The moment of the free layer 504 responds to the magnetic signal. In magnetic recording, the free layer 504 rotates following the magnetic field from a platter. Measuring a read head's resistance is used to read back information recorded on a platter.

Figure 5B:
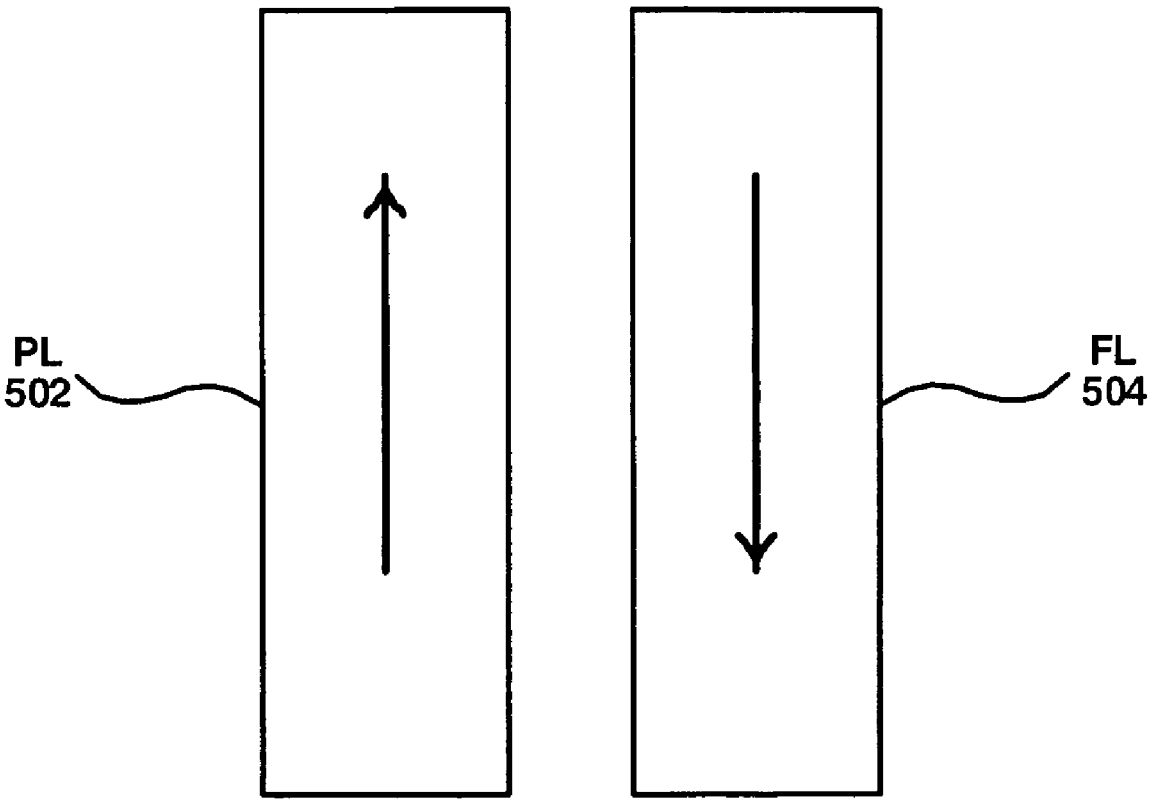
Figure 5C:
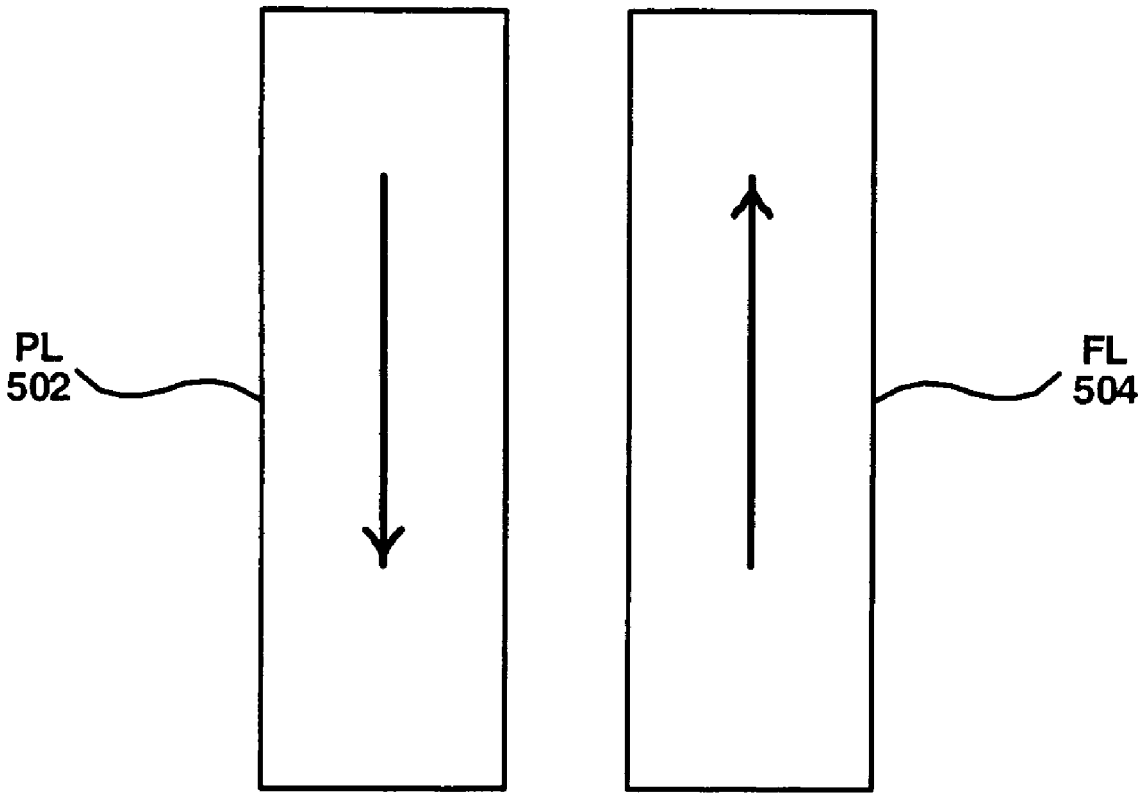
Figure 5D:
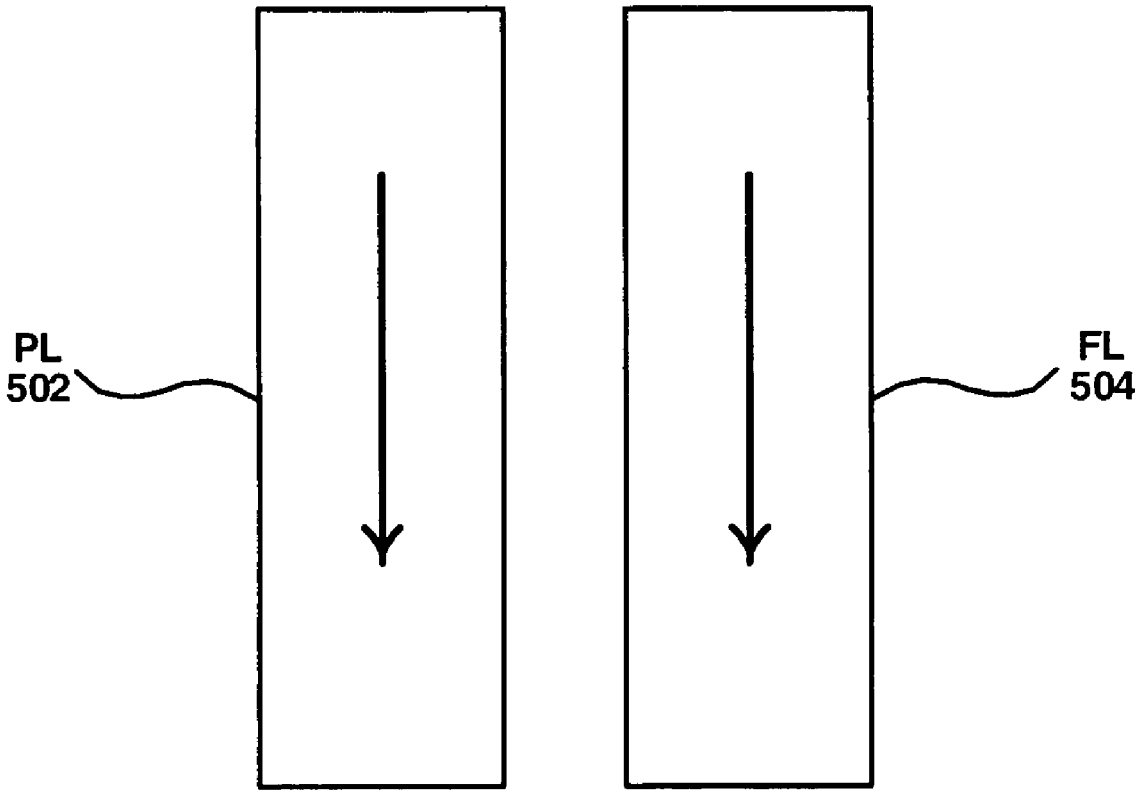

For the sake of simplicity, the moment of the free layer 504 is depicted as rotating by 180 degrees (as depicted in FIGS. 5A-5D). For example, FIG. 5B depicts the free layer 504 as having rotated 180 degrees with respect to FIG. 5A. Similarly, FIG. 5D depicts the free layer 504 as having rotated 180 degrees with respect to FIG. 5C. However, typically the moment of the free layer 504 rotates by angles much smaller than 180 degrees, and the angle increases with the magnetic fields.

As a lapping plate 230 is damaged by scratches created during the diamond charging process or lapping process, or due to large cluster of diamonds embedded into the plate 230 or some other types of damage, it (230) will exert more mechanical stress on a read sensor 246. This can cause the moment of the pinning layer 502 to reverse its (502) direction (also commonly known as a "flipped pinning layer 502") as depicted in FIGS. 5C and 5D. For example, the arrow for the pinning layer 502 as depicted in FIGS. 5C and 5D are pointing downwards (e.g., flipped) whereas in FIGS. 5A and 5B the arrows are pointing upwards. Positive magnetic field which would otherwise lead to the free-layer 504 and pinning layer 502 being parallel will now make those two layers 502, 504 anti-parallel. As a result, the amplitude will become negative, thus, binary Is will appear to be binary 0s to the read sensor 246 (FIG. 5C) and binary 0s will appear to be binary 1s to the read sensor 246 (FIG. 5D).

Figure 6A:
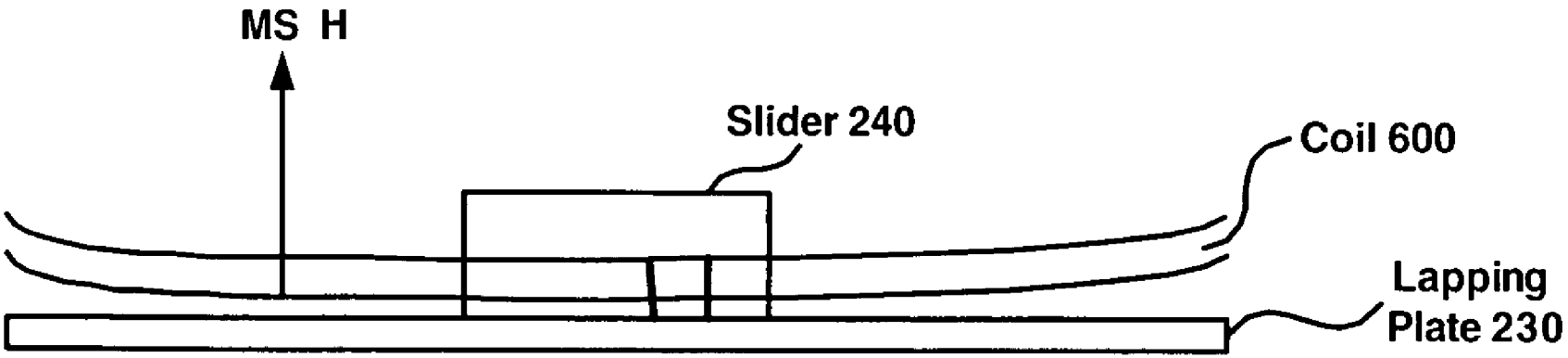
FIGS. 6A and 6B depict a coil that generates a magnetic signal while a slider is being lapped, according to one embodiment.
Figure 6B:
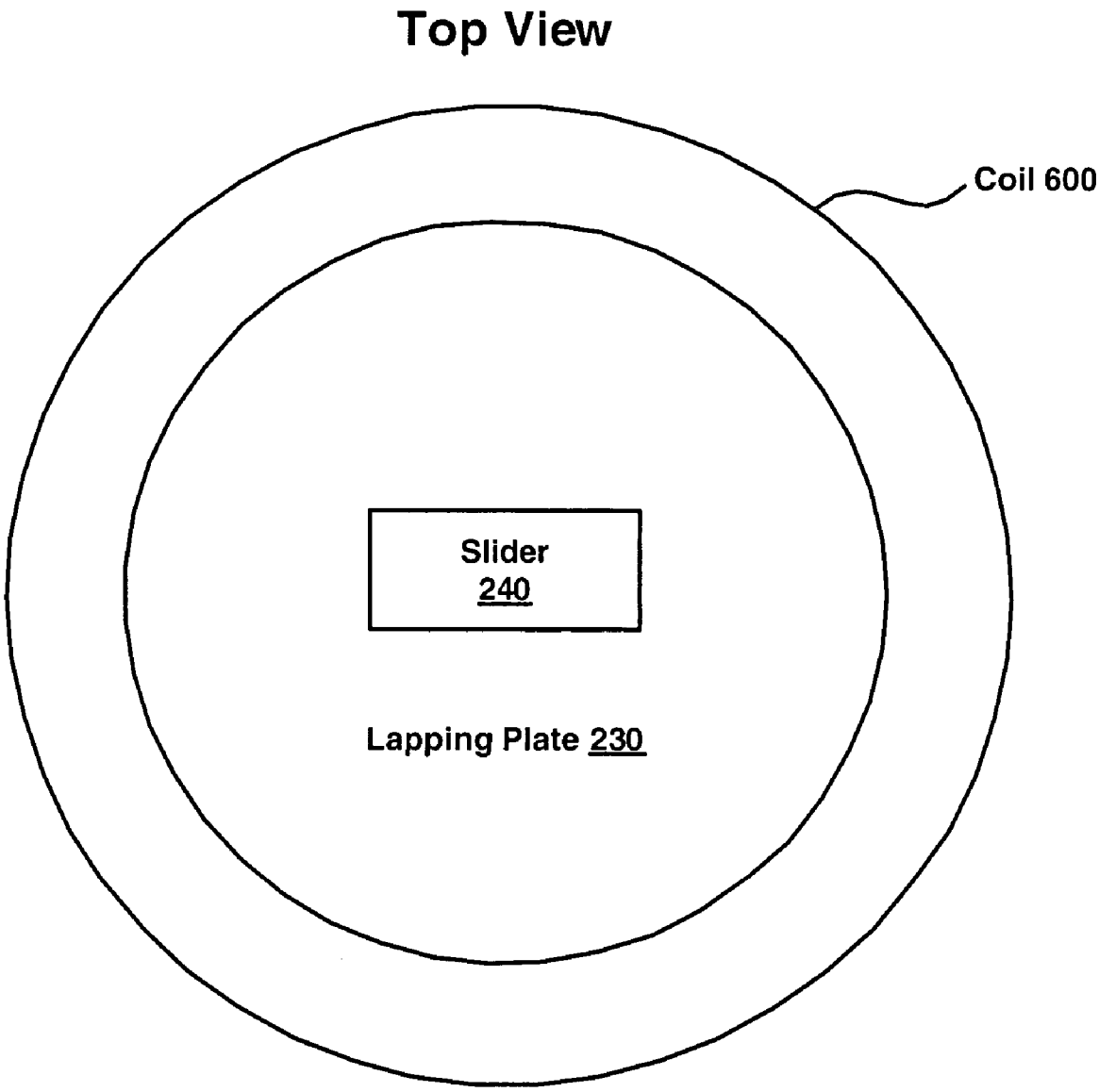

According to embodiments of the present invention, the amplitude of the magnetic signal from the platter can be used for evaluating the quality of a lapping plate 230. For example, the amplitude of the magnetic signal from the platter can be used for determining whether the moment of the pinning layer 502 has reversed. For example, FIGS. 6A, and 6B depict using amplitude of the magnetic signal to evaluate the quality of a lapping plate 230, according to embodiments of the present invention.

According to one embodiment, an apparatus that generates a magnetic signal with a known value can be used for determining whether the amplitude has reversed. For example, the apparatus can include a coil that generates a magnetic signal of a known value. FIGS. 6A and 6B depict a coil 600 that generates a magnetic signal H while a slider 240 is being lapped, according to one embodiment. More specifically, FIG. 6A depicts a side view of a slider 240 being lapped by a lapping plate 230. FIG. 6B depicts a top view of the slider 240 being lapped by the lapping plate 230. In both FIGS. 6A and 6B the slider 240 is surrounded by a coil 600 that generates a magnetic signal H (e.g., an external field) with a known value. Although FIGS. 6A and 6B depict the coil 600 surrounding only one slider 240, the coil 600 can surround more than one slider. Further, the coil 600 can be above or below the lapping plate 230. Additionally, the coil 600 can be inside the perimeter of the lapping plate 230 or outside the perimeter of the lapping plate 230.

Figure 7A:
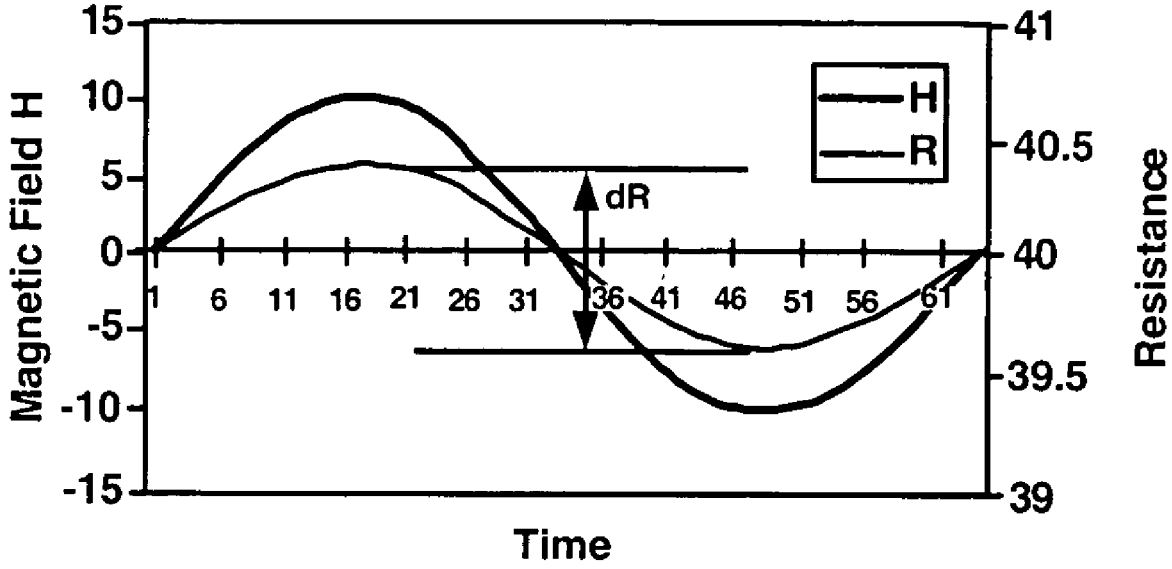
FIG. 7A depicts a graph where the resistance R is in-phase with the magnetic signal, according to one embodiment.
Figure 7B:
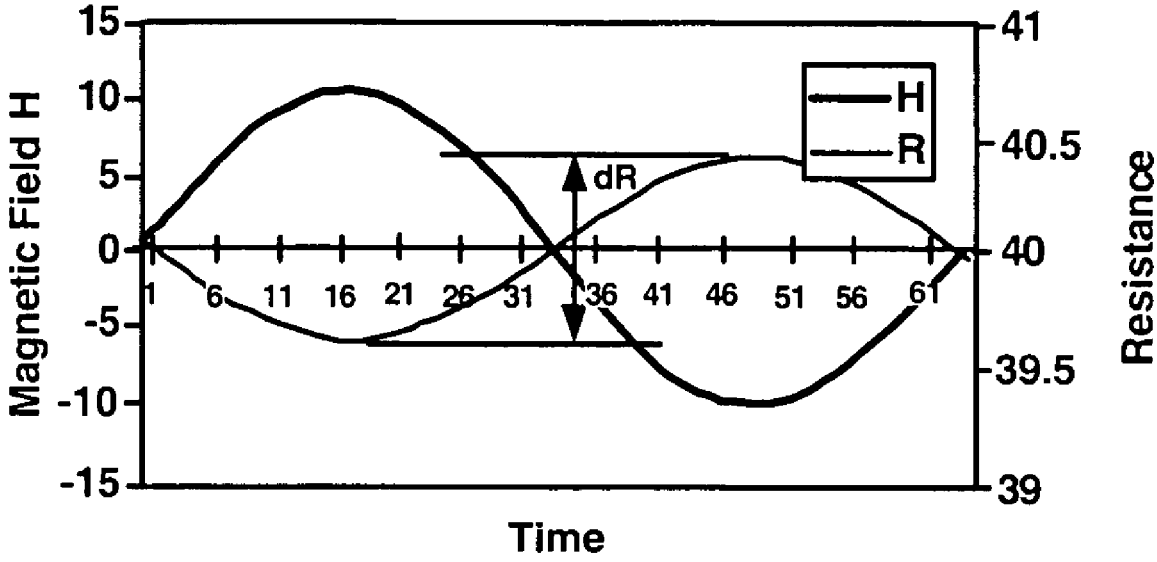
FIG. 7B depicts a graph where the resistance R is out-of-phase with the magnetic signal, according to one embodiment.

The read sensor 246 detects the magnetic signal H generated by the coil 600 and the amplitude in response to the magnetic signal H is measured, according to one embodiment. If the pinning layer 502 has not been damaged by the lapping plate 230, then the resistance R will be in-phase with the magnetic signal H generated by the coil 600 as depicted in FIG. 7A, according to one embodiment. However, if the pinning layer 502 has been reversed by the lapping plate 230, then the resistance R will be out-of-phase with the magnetic signal H as depicted in FIG. 7B, according to another embodiment.

For example, amplitude can be measured as dR/R where dR is the change in resistance in response to the magnetic signal H, and R is the average resistance. When the change in resistance R is in-phase with the change in the magnetic signal H, the amplitude is positive as depicted in FIG. 7A. When the change in resistance R is 180 degrees out-of-phase, the amplitude is negative (e.g., reversed amplitude) as depicted in FIG. 7B. More specifically, in FIG. 7A, the amplitude dR/R is positive and is equal to 0.8 Ohm/40 Ohm-2.0%, whereas in FIG. 7B, the resistance has changed 180 degrees out-of-phase as a result of the magnetic field H changing. The amplitude dR/R is negative and is equal to −0.8 Ohm/40 Ohm=−2.0%.

Figure 7C:
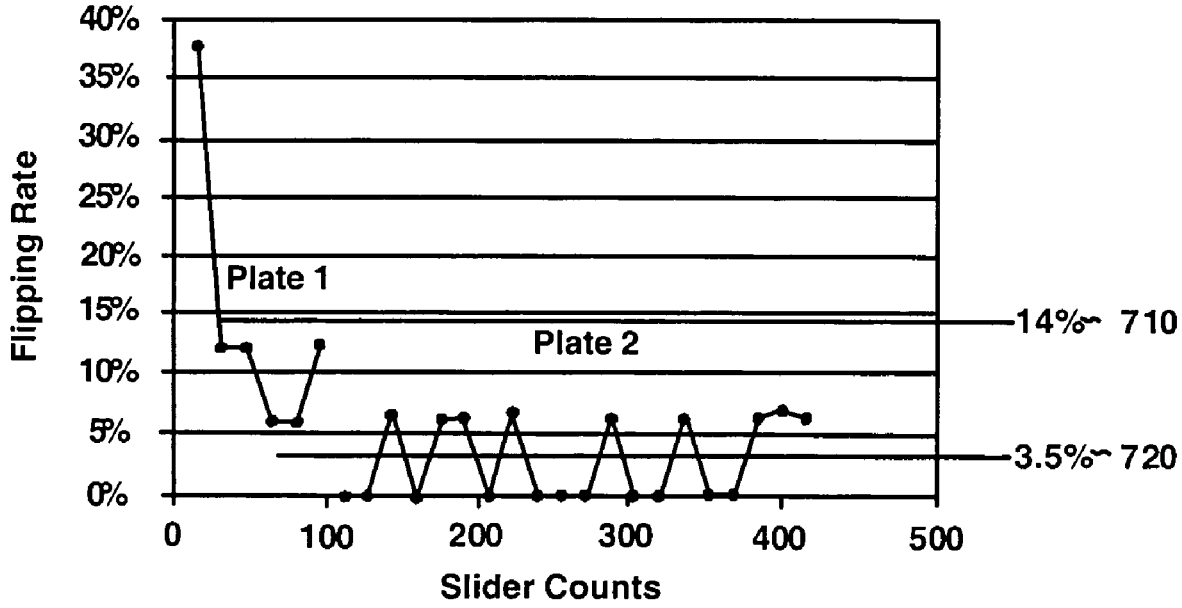
FIG. 7C depicts the percent of sliders from a single wafer, where the percentage of sliders which have reversed pinning layers varies between lapping plates, according to an embodiment.

According to another embodiment, the percent of sliders with reversed pinning layers 502 can be used to evaluate the quality of a lapping plate 230. For example, the sliders from a single wafer can be analyzed to determine what percent of the sliders had reversed pinning layers 502, according to another embodiment. FIG. 7C depicts the percent of sliders from a single wafer, where the percentage of sliders which have reversed pinning layers varies between lapping plates, according to an embodiment. As depicted in FIG. 7C, each point is the average over a plurality of sliders, such as 16 sliders for example. Some of the sliders were lapped with a lapping plate 1 and some of the slides were lapped with a lapping plate 2. As depicted in FIG. 7C, lapping plate 1 resulted in approximately 14% (at point 710) of the sliders having reversed pinning layers 502 and lapping plate 2 resulted in approximately 3.5% (at point 720) of the sliders having reversed pinning layers 502. Therefore, lapping plate 1 has worse quality than lapping plate 2. According to one embodiment, if a lapping plate causes a certain percentage, such as 4% as depicted in 7C, or more sliders to have a reversed a pinning layer, then the lapping plate has inadequate quality. In this case, the lapping plate 2 can be replaced with a new lapping plate.

The percentage of sliders with reversed pinning layers 502 is largely dependent on the design of the head and the quality of the head. The criteria that is chosen for evaluating the quality of a lapping plate is related to the design and structure of a head. For example, although FIG. 7C depicts 4% as the criteria, another percentage may be used for a head with a different design and structure.

The information receiver 210 receives information 250 that indicates the amplitude of the magnetic signal, according to one embodiment, and the quality determiner 220 uses amplitude to evaluate the quality of a lapping plate 230 while the lapping plate 230 is being used to lap a slider 240, according to another embodiment. For example, the information receiver 210 can receive a measurement of the amplitude or more than one measurement of the amplitude for a slider 240 over time. The quality determiner 220 can use the one or more measurements of the amplitude to determine whether amplitude has reversed.

The quality determiner 220 can use the amplitude to calculate the percent of sliders with reversed pinning layers 502 (also commonly known as "flip rate") as depicted in FIG. 7C. Further the quality determiner 220 can use the calculated percent of sliders to determine whether the lapping plate has inadequate quality based on the criteria described herein. The quality determiner 220 can compare the calculated percent of sliders with reversed pinning layers 502 to the chosen criteria and determine whether the lapping plate is adequate or not, according to embodiments described herein. More specifically, as depicted in FIG. 7C, plate 1 can be replaced since plate 1 resulted in more than 4% of the sliders that were lapped with plate 1 having reversed pinning layers 502.

Method of Evaluating the Quality of a lapping Plate

Figure 8:
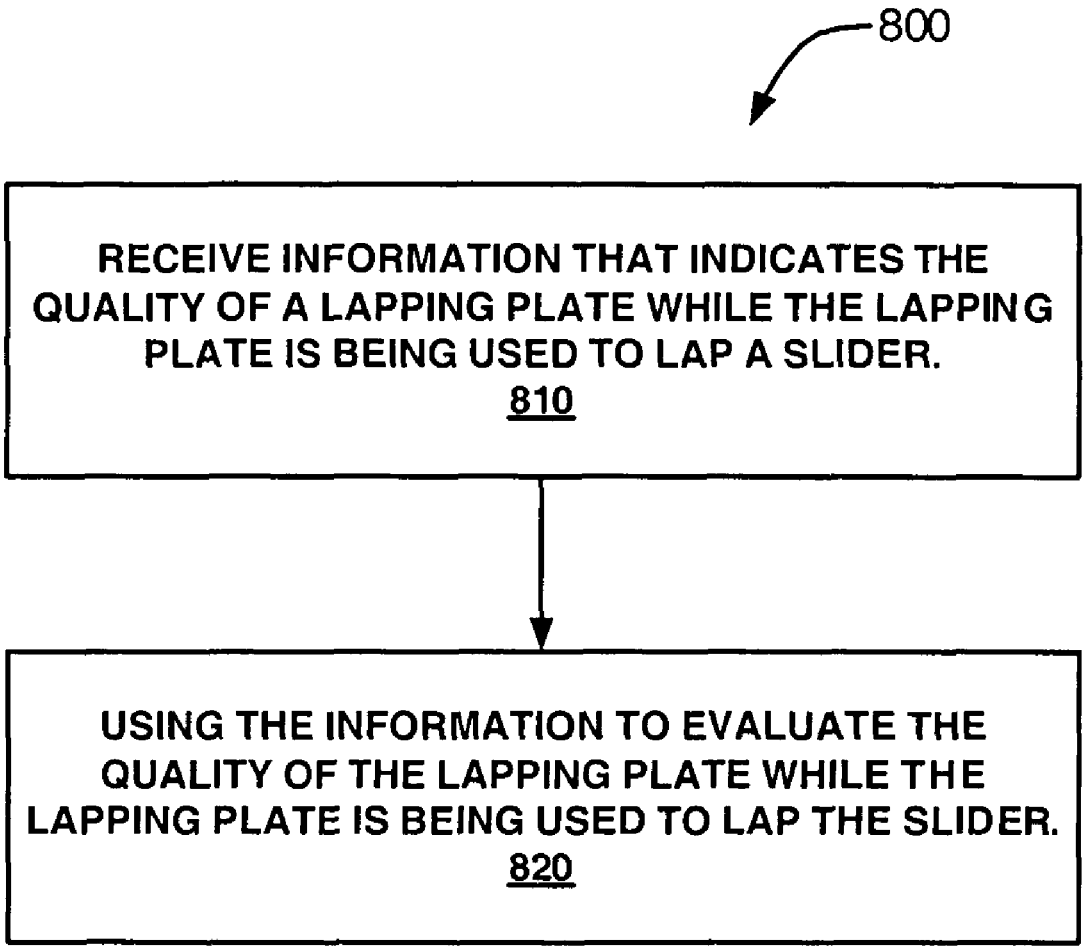
FIG. 8 depicts a flowchart 800 for a method of evaluating the quality of a lapping plate, according to embodiments of the present invention.

FIG. 8 depicts a flowchart 800 for a method of evaluating the quality of a lapping plate, according to embodiments of the present invention. Although specific steps are disclosed in flowchart 800, such steps are exemplary. That is, embodiments of the present invention are well suited to performing various other steps or variations of the steps recited in flowchart 800. It is appreciated that the steps in flowchart 800 may be performed in an order different than presented, and that not all of the steps in flowchart 800 may be performed.

In step 810, information that indicates the quality of a lapping plate is received while the lapping plate is being used to lap a slider 240. For example, information 250 indicating the quality of the lapping plate 230 is received by the information receiver 210 associated with the apparatus 200. The information 250 can indicate the amount of resistance associated with the slider 240 and/or the information 250 can indicate the amplitude of a magnetic signal detected by a read sensor 246.

More specifically in one example, the information receiver 210 can receive a measurement of the amount of resistance R for a slider 240 or more than one measurement of the resistance R for a slider 240 over time. In another example, the information receiver 210 can receive a measurement of the amplitude or more than one measurement of the amplitude for a slider 240 over time.

In step 820, the information is used to evaluate the quality of the lapping plate while the lapping plate is being used to lap the slider 240. For example, the information 250 indicating the quality of the lapping plate 230 is provided to the quality determiner 250 which evaluates the quality of the lapping plate 230 based on the information 250 while the lapping plate 230 is being used to lap the slider 240.

More specifically in one example, the quality determiner 220 can use the one or more measurements of the resistance R to determine whether the resistance R is fluctuating. The quality determiner 220 can calculate an average of more than one measurement of resistance R as depicted in FIG. 4A, a sigma/mean as depicted in FIG. 4B, and/or a histogram as depicted in FIG. 4C. Further the quality determiner 220 can use the resistance R to determine whether the lapping plate has inadequate quality based on the criteria described herein. Examples of criteria include, but are not limited to, determining that the resistance R drops by approximately 1% or more or determining that the sigma/mean measurement of resistance fluctuates by 1% or more. The lapping plate 230 can be replaced if it (230) has inadequate quality.

In another example, the quality determiner 220 can use amplitude to calculate the percent of sliders with reversed pinning layers 502 as depicted in FIG. 7C. Further, the quality determiner 220 can use the calculated percent of sliders which have reversed amplitude to determine whether the lapping plate has inadequate quality based on the criteria described herein. Examples of criteria include, but are not limited to, determining whether a slider has caused 4% or more sliders to have reversed pinning layers. The lapping plate 230 can be replaced if it (230) has inadequate quality.

Conclusion

Although many of the embodiments described herein referred to reducing the probability of damaging a read sensor 246, embodiments of the present invention can also be used for reducing the probability of damage to a write head 248 as well.

What is claimed is:

1. A method of evaluating the quality of a lapping plate, the method comprising:

magnetically shielding at least one side of a read sensor disposed within a slider and shielding from particles associated with said lapping plate;

receiving information from said read sensor that indicates the quality of a lapping plate while the lapping plate is being used to lap said slider; and using a quality determiner configured to process the information to evaluate the quality of the lapping plate while the lapping plate is being used to lap the slider and which is further configured to determine when the quality of the lapping plate has degraded beyond a threshold value.

2. The method as recited in claim 1, wherein the receiving of the information that indicates the quality of a lapping plate while the lapping plate is being used to lap a slider further comprises:

said quality determiner receiving information that indicates resistance associated with the slider.

3. The method as recited in claim 2, wherein the using of the information to evaluate the quality of the lapping plate while the lapping plate is being used to lap the slider, further comprises:

using said quality determiner to process the information and to determine whether the resistance is fluctuating.

4. The method as recited in claim 3, wherein the using of the information to determine whether the resistance is fluctuating further comprises:

using said quality determiner to determine whether the resistance fluctuates by more than a certain percentage; and if the resistance fluctuates by more than the certain percentage determining that the quality of the lapping plate is inadequate.

5. The method as recited in claim 4, wherein the certain percentage is 1%.

6. The method as recited in claim 2, wherein the using of the information to evaluate the quality of the lapping plate while the lapping plate is being used to lap the slider further comprises:

using said quality determiner to calculate an average of the resistance; and said quality determiner using the average of the resistance to evaluate the quality of the lapping plate.

7. The method as recited in claim 6, further comprising:

said quality determiner using measurements of the resistance received over a time interval that is between 10 milliseconds and 10 seconds to compute the average of the resistance.

8. The method as recited in claim 6, wherein the using of the average of the resistance to evaluate the quality of the lapping plate further comprises:

using said quality determiner to determine whether the average of the resistance fluctuates by more than a certain percentage; and if the average of the resistance fluctuates by more than the certain percentage determining that the quality of the lapping plate is inadequate.

9. The method as recited in claim 7, wherein the certain percentage is 1%.

10. The method as recited in claim 1, wherein the using of the information to evaluate the quality of the lapping plate while the lapping plate is being used to lap the slider further comprises:

using said quality determiner to calculate an a root mean square of the resistance divided by an average of the resistance; and using the root mean square of the resistance divided by the average of the resistance to evaluate the quality of the lapping plate.

11. The method as recited in claim 10, further comprising:

said quality determiner using measurements of the resistance received over a time interval that is between 10 milliseconds and 10 seconds to compute the root mean square of the resistance and the average of the resistance.

12. The method as recited in claim 10, wherein the using of the root mean square of the resistance divided by the average of the resistance to evaluate the quality of the lapping plate further comprises:

using said quality determiner to determine whether the root mean square of the resistance divided by the average of the resistance is greater than a certain percentage; and if the root mean square of the resistance divided by the average of the resistance is greater than the certain percentage determining that the quality of the lapping plate is inadequate.

13. The method as recited in claim 12, wherein the certain percentage is 1%.

14. The method as recited in claim 1, wherein the receiving of the information that indicates the quality of a lapping plate while the lapping plate is being used to lap the slider further comprises:

said quality determiner receiving information that indicates amplitude associated with the slider.

15. The method as recited in claim 1, wherein the using of the information to evaluate the quality of the lapping plate while the lapping plate is being used to lap the slider further comprises:

said quality determiner using the information that indicates the amplitude to determine whether the amplitude is reversed.

16. The method as recited in claim 15, wherein the using of the information that indicates the amplitude to determine whether the amplitude is reversed further comprises:

using said quality determiner to determine whether the lapping plate causes a certain percentage or more of sliders being lapped with the lapping plate to have reversed amplitudes.

17. The method as recited in claim 16, wherein the certain percentage is 4%.

18. The method as recited in claim 16, further comprising:

said quality determiner determining that a moment of a pinning layer associated with the slider is reversed based on the amplitude.

19. The method as recited in claim 1, wherein the using of the information to evaluate the quality of the lapping plate while the lapping plate is being used to lap the slider further comprises:

said quality determiner using the information to reduce the probability of damaging a sensor associated with the slider.

* * * * *